US006583539B1

(12) United States Patent
Zamora

(10) Patent No.: US 6,583,539 B1
(45) Date of Patent: Jun. 24, 2003

(54) SPARK PLUG WITH CENTER ELECTRODE AND SURROUNDING GROUND ELECTRODE

(76) Inventor: Antonio Lopez Zamora, P.O. Box 55, 10222 Hammerly, Houston, TX (US) 77043

( * ) Notice: Subject to any disclaimer, the term of this patent is extended or adjusted under 35 U.S.C. 154(b) by 130 days.

(21) Appl. No.: 09/645,045

(22) Filed: Aug. 23, 2000

Related U.S. Application Data

(60) Provisional application No. 60/150,194, filed on Aug. 23, 1999.

(51) Int. Cl.[7] ..... H01T 13/32; H01T 13/28; H01T 13/46

(52) U.S. Cl. ..... 313/143; 313/141

(58) Field of Search ..... 313/141, 142, 313/143, 133

(56) References Cited

U.S. PATENT DOCUMENTS 1,247,049 A * 11/1917 Willett ..... 313/133
1,249,830 A * 12/1917 Rider ..... 313/141
1,513,057 A * 10/1924 MacDonald ..... 313/141
2,609,808 A * 9/1952 Bychinsky ..... 313/141

FOREIGN PATENT DOCUMENTS

GB 2 219 625 A * 12/1989 ..... H01T/13/54

* cited by examiner

*Primary Examiner*—Michael H. Day
(74) *Attorney, Agent, or Firm*—Kenneth A. Roddy

(57) ABSTRACT

Spark plugs having a center electrode and surrounding ground electrode configurations that allow the spark to selectively fire across the path of least resistance are disclosed. In one embodiment the plug has a cylindrical ground electrode with plural inverted V-shaped projections at its outer end that face outwardly from the end of the electrode. The side wall of the ground electrode may be provided with apertures to facilitate radial gas flow. In another embodiment the ground electrode has plural spherical projections at its outer end. In another embodiment the ground electrode is a cylindrical foraminous configuration with inverted V-shaped projections at its outer end. In another embodiment the center electrode has a spherical outer end encircled by and a cylindrical ground electrode. In another embodiment the center electrode has a spherical outer end surrounded by a hemispherical foraminous dome-shaped ground electrode.

5 Claims, 5 Drawing Sheets

SPARK PLUG WITH CENTER ELECTRODE AND SURROUNDING GROUND ELECTRODE

CROSS REFERENCE TO RELATED APPLICATION

This application claims priority of U.S. Provisional Application Serial No. 60/150,194, filed Aug. 23, 1999.

BACKGROUND OF THE INVENTION

1. Field of the Invention

This invention relates generally to spark plugs, and more particularly to lateral firing spark plugs and spark plugs having electrode configurations that allow the spark to selectively fire across the path of least resistance.

2. Brief Description of the Prior Art

A conventional spark plug for combustion engines has a center electrode embedded in a ceramic insulator and an outer, inverted L-shaped grounding electrode spaced from the outer tip end of the center electrode by a narrow gap. The spark jumps across the gap between the center electrode and the grounding electrode.

The convention spark plug requires frequent replacement under normal wear for several reasons. Over a period of time, the optimal gap between the two electrodes is altered due to wear and pitting caused by the repeated high voltage firing. Wear and pitting increases the electrical potential needed for discharge and often results in weak sparks and failure to spark when required. Carbonization and the depositing of lead, lead oxide, and other contaminants in and around the electrodes during the course of repeated electrical discharges also alter the dimensions of the spark gap and reduces the life of the plug, reduces engine efficiency, and increases fuel consumption.

There are several patents that disclose spark plugs that have an annular ground electrode.

Franks, U.S. Pat. No. 3,958,144 discloses spark plugs having an annular grounding electrode that provides a number of alternate sparking paths wherein both electrode surfaces are formed of alloy consisting of 75% nickel, 15% chromium, 5% iron, and the remainder copper.

Lindsay, U.S. Pat. No. 4,730,582 discloses a spark plug for having an annular ground ring with a circular opening surrounding the center electrode. The ground ring may include a series of ports to facilitate disbursement of the ignited fuel/air mixture from the spark plug.

Kagawa, et al, U.S. Pat. No. 4,914,343 discloses a spark plug having an outer electrode configured as a flat plate vertically spaced from the tip end of the center electrode by a plurality of spider legs with a plurality of holes formed in the plate to improve the plug durability and retard any discharge voltage increases.

Johnson, U.S. Pat. No. 5,280,214 and Smith, U.S. Pat. No. 5,408,961 disclose spark plugs having a circular or semi-circular ring shaped ground electrode supported by one or more mounting posts in vertically spaced relation from the tip end of the center electrode or surrounding the center electrode.

Buhl, U.S. Pat. No. 5,623,179 discloses a spark plug having diagonally disposed electrode projections or elements extending from a central electrode through V-shaped or elliptical grounding windows or apertures formed in a cylindrical outer grounding electrode skirt.

Lindsay, U.S. Pat. No. 5,633,557 discloses an anti-fouling spark plug having an annular ground ring with a circular opening surrounding the center electrode. The inner diameter of the circular opening has a sharpened point. In another embodiment, the circular opening has a sawtooth configuration with the points of the sawtooth configuration facing radially inward toward the center electrode. The ground ring may include a series of ports to facilitate disbursement of the ignited fuel/air mixture from the spark plug.

Rossi, U.S. Pat. No. 5,892,319 discloses a top and side firing spark plug having a center electrode surrounded by a ground electrode wherein a large plurality of sharp edges such as screw threads, knurls, and various projections are provided on the center electrode, the ground electrode, or both. In one embodiment the ground electrode has a sawtooth configuration with the points of the sawtooth configuration facing radially inward toward the center electrode.

The present invention is distinguished over the prior art in general, and these patents in particular by a spark plug having a center electrode and surrounding ground electrode configuration that allows the spark to selectively fire across the path of least resistance. In one embodiment the plug has a cylindrical ground electrode with plural inverted V-shaped projections at its outer end that face outwardly from the end of the electrode. The side wall of the ground electrode may be provided with apertures to facilitate radial gas flow. In another embodiment the ground electrode has plural spherical projections at its outer end. In another embodiment the ground electrode is a cylindrical foraminous configuration with inverted V-shaped projections at its outer end. In another embodiment the center electrode has a spherical outer end encircled by and a cylindrical ground electrode. In another embodiment the center electrode has a spherical outer end surrounded by a hemispherical foraminous dome-shaped ground electrode.

SUMMARY OF THE INVENTION

It is therefore an object of the present invention to provide a spark plug having novel and improved electrode configurations.

It is another object of this invention to provide a spark plug having an extended lifetime.

Another object of this invention is to provide a spark plug with center and ground electrodes having greatly improved resistance to wear, pitting and physical deterioration.

Another object of this invention is to provide a spark plug having a ground electrode configuration with a plurality of grounding electrode projections that enable the spark from a center electrode to selectively fire across the path of least resistance.

Another object of this invention is to provide a spark plug having a center electrode and ground electrode configuration that will increase fuel economy and increase engine efficiency.

Another object of this invention is to provide a spark plug having a center and ground electrode configuration that reduces accumulation of contaminating deposits on the electrodes during operation.

A further object of this invention is to provide a spark plug with a center electrode and ground electrode configuration that will reduce exhaust emissions.

A still further object of this invention is to provide a spark plug with a novel center electrode and grounding electrode configuration that can be manufactured inexpensively from conventional materials.

Other objects of the invention will become apparent from time to time throughout the specification and claims as hereinafter related.

The above noted objects and other objects of the invention are accomplished by a spark plug having a center electrode and surrounding ground electrode configuration that allows the spark to selectively fire across the path of least resistance. In one embodiment the plug has a cylindrical ground electrode with plural inverted V-shaped projections at its outer end that face outwardly from the end of the electrode. The side wall of the ground electrode may be provided with apertures to facilitate radial gas flow. In another embodiment the ground electrode has plural spherical projections at its outer end. In another embodiment the ground electrode is a cylindrical foraminous configuration with inverted V-shaped projections at its outer end. In another embodiment the center electrode has a spherical outer end encircled by and a cylindrical ground electrode. In another embodiment the center electrode has a spherical outer end surrounded by a hemispherical foraminous dome-shaped ground electrode.

DESCRIPTION OF THE PREFERRED EMBODIMENTS

Figure 1:
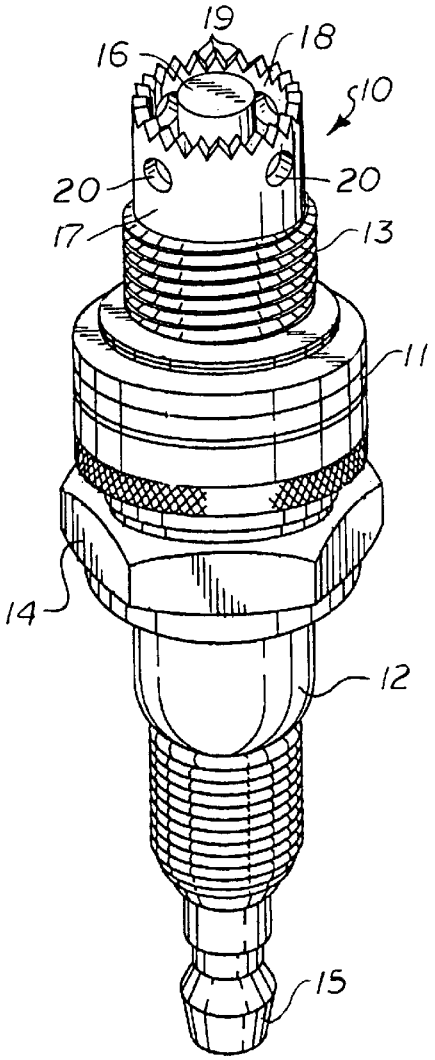
FIG. 1 is a perspective view of a spark plug having a cylindrical ground electrode with plural inverted V-shaped projections at its outer end in accordance with a first embodiment of the present invention.

Referring to the drawings by numerals of reference, there is shown in FIG. 1, a spark plug 10 constructed in accordance with a first preferred embodiment of the present invention. The upper portion of the spark plug 10 is similar to conventional spark plugs. The inventive differences of the spark plug 10 are evident in the lower or forward portion of the plug.

As with a conventional spark plug, the spark plug 10 of the present invention shown in FIG. 1 includes a steel shell or body 11 which holds and encompasses an insulator 12 formed from an electrically non-conductive material such as ceramic or other equivalent material. The shell or body 11 has an externally threaded cylindrical shank portion 13 for engagement with the internal threads of an engine cylinder port, and a hexagonal nut portion 14 for wrench tightening the plug 10.

A high-voltage terminal 15 formed from an electrically conductive material is seated in the insulator 12. The terminal 15 is connected to an internal conductor (not shown) that extends longitudinally through the insulator 4 and carries a cylindrical center electrode 16 at the forward or lower end of the spark plug that serves as an anode.

The center electrode 16 may be formed of conventional spark plug anode materials, however, copper, silver, stainless steel, titanium or alloys thereof are preferred.

In the present invention, a cylindrical outer ground electrode 17 extends from the forward end of the threaded shank portion 13 and coaxially encircles the center electrode 16 defining an annular spark plug gap 18 between the two electrodes. The opposed facing circular vertical surfaces of electrodes 16 and 17 are substantially parallel. The outer electrode 17 is electrically connected with the threaded shank portion 13 and forms an electrical ground when the plug is mounted in the cylinder.

The outer electrode 17 may be formed of conventional spark plug ground electrode materials, however, stainless steel is preferred.

In the embodiment of FIG. 1 a plurality of circumferentially spaced V-shaped grooves are formed in the front end of the side wall of the outer electrode 17 and define a plurality of inverted V-shaped projections 19 therebetween that face outwardly from the end of the ground electrode. One or more apertures or holes 20 are formed through side wall of the outer electrode 17. The V-shaped grooves and the holes 20 enable radial gas flow between the spark plug gap 18 and the exterior of the outer electrode 17. The irregular surfaces defined by the V-shaped grooves and inverted V-shaped projections 19 also cause turbulence in the gas flowing thereacross.

In operation, high tension voltage passes through the center electrode 16 to the inverted V-shaped projections 19. The voltage will discharge in the form of a spark that jumps laterally from the top edge of the center electrode 16 to one or more of the inverted V-shaped projections 19. Because there are a plurality of grounding electrode projections 19, the spark will selectively fire across the path of least resistance.

Thus, if all of the projections 19 are equally worn and clean and of the same temperature, there could be several separate sparks. In most instances, the spark will sequentially fire across to various ones of the projections, in a clockwise or counter-clockwise direction, in a pinwheel fashion, selecting the electrode projections that are the cleanest, least worn, and have a temperature conducive to grounding the spark. As some of the projections become worn or accumulate deposits, the spark will continue to selectively fire to the projections offering the least resistance until the physical condition of the later projections become worse than former projections. Thus, the projections 19 will tend to wear generally evenly, and because there are many projections, the plug will last longer and maintain maximum firing capability much longer than conventional plugs having only one grounding electrode.

Because the holes 20 in the side wall allow radial gas flow between the spark plug gap 18 and the exterior of the outer electrode 17 and the irregular surfaces of the V-shaped grooves and inverted V-shaped projections 19 cause turbulence in the gas adjacent the electrodes, the fuel/air mixture is improved and unburned gases will be recirculated and ignited. The plurality of projections also facilitate dissipation of heat. Thus, the electrodes will have less accumulation of contaminating deposits, and the engine will be more efficient and have increased fuel economy, and reduced exhaust emissions.

Figure 2:
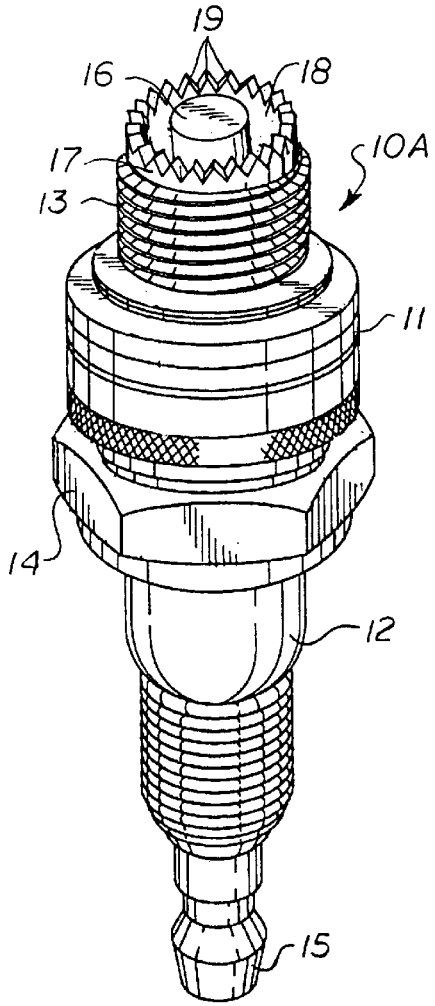
FIG. 2 is a perspective view of a second embodiment of a spark plug having a cylindrical ground electrode with plural inverted V-shaped projections at its outer end.

FIG. 2 illustrates spark plug 10A having an electrode configuration similar to the embodiment of FIG. 1, but the center electrode 16 and cylindrical outer electrode 17 are shorter, and there are no holes formed in the side wall of the outer electrode. The reference numerals from FIG. 1 designating the same components are carried over to FIG. 2, but the components will not be described again in detail to avoid repetition.

Figure 3:
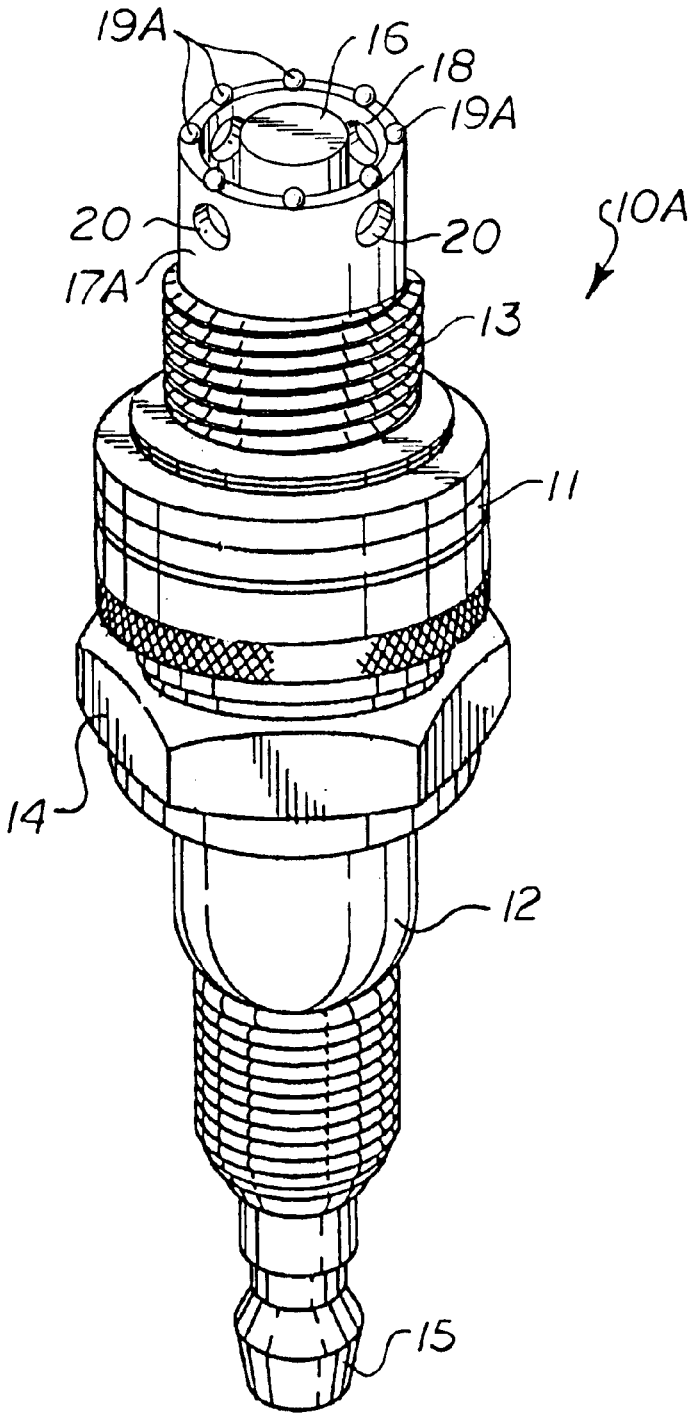
FIG. 3 is a perspective view of a spark plug having a cylindrical ground electrode with plural spherical projections at its outer end in accordance with a third embodiment of the present invention.

FIG. 3 illustrates a lateral firing spark plug 10B having a cylindrical ground electrode 17A with a plurality of small circumferentially spaced spherical projections 19A at its outer end. The reference numerals from FIG. 1 designating the same components are carried over to FIG. 3, but the components will not be described again in detail to avoid repetition. It should be understood, that the cylindrical outer electrode 17A may provided without the holes 20 formed in its side wall.

Figure 4:
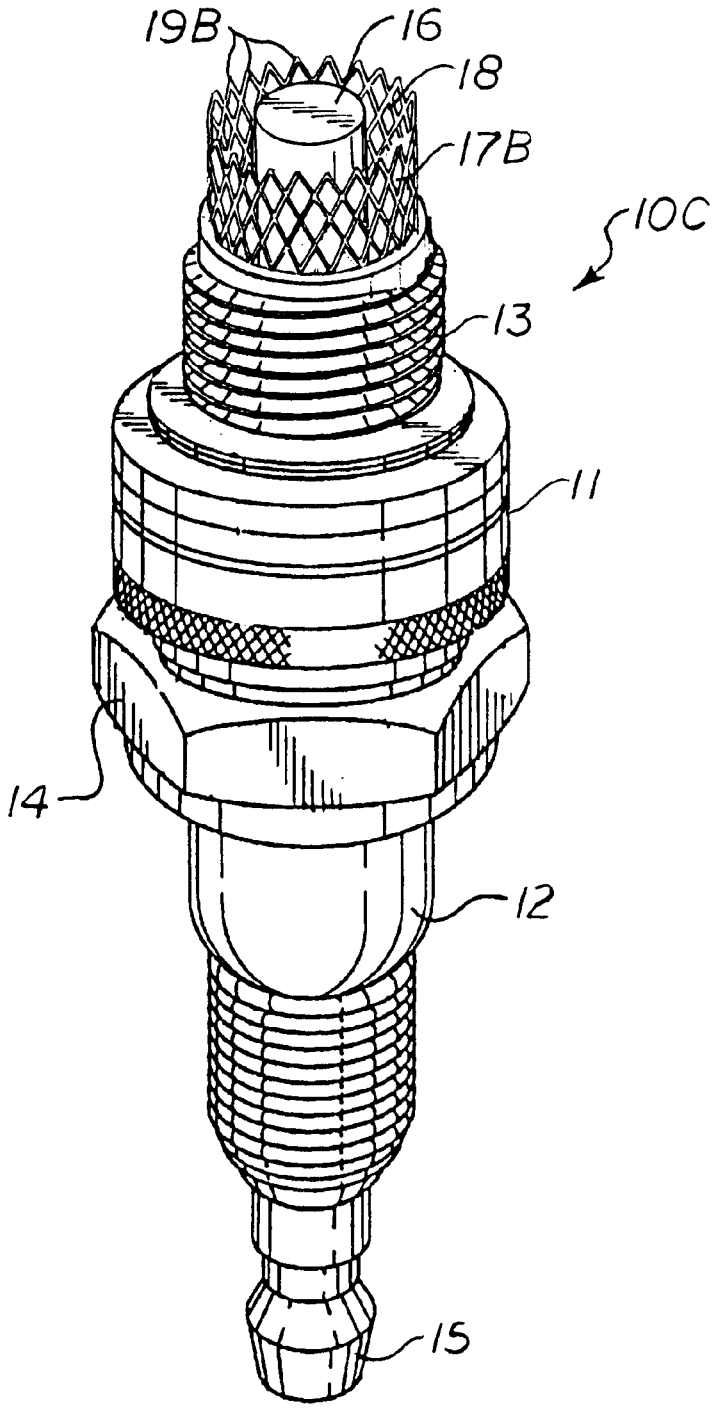
FIG. 4 is a perspective view of a spark plug having a cylindrical foraminous ground electrode with plural inverted V-shaped projections at its outer end in accordance with a fourth embodiment of the present invention.

FIG. 4 illustrates a fourth embodiment of the lateral firing spark plug 10C. The reference numerals from FIG. 1 designating the same components are carried over to FIG. 4, but the components will not be described again in detail to avoid repetition. In this embodiment a foraminous cylindrical outer ground electrode 17B extends from the forward end of the threaded shank portion 13 and coaxially encircles the center electrode 16. The outer electrode 17B is formed of open mesh or expanded metal material having a sieve-like apertured side wall with a plurality of circumferentially spaced inverted V-shaped projections 19B at its outer end. The apertured sieve-like side wall facilitates radial gas flow between the spark plug gap 18 and the exterior of the outer electrode 17B and also causes turbulence in the gas flowing therethrough. The outer electrode 17B may be formed of conventional spark plug ground electrode materials, however, stainless steel is preferred.

Figure 5:
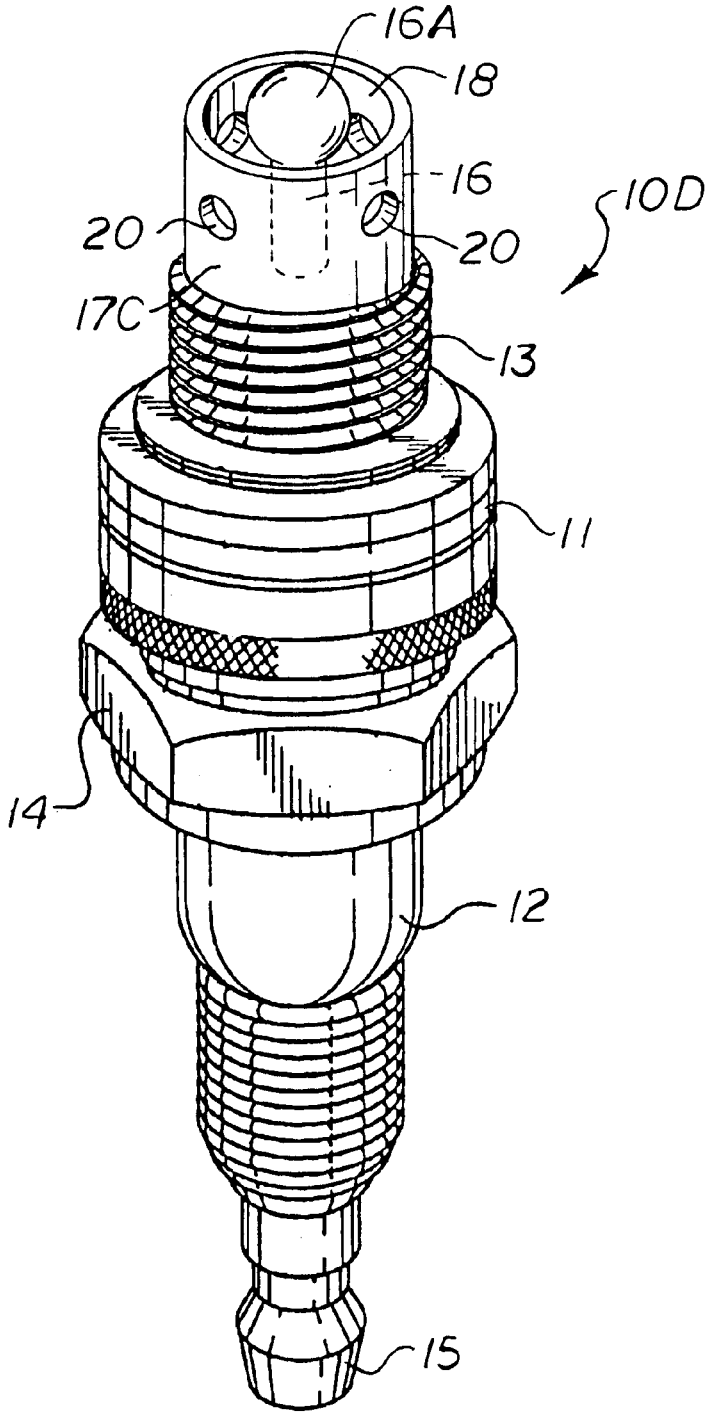
FIG. 5 is a perspective view of a spark plug having a spherical center electrode and a cylindrical ground electrode in accordance with a fifth embodiment of the present invention.

FIG. 5 illustrates a fifth embodiment of a spark plug 10D having a center electrode 16 with a spherical outer end 16A coaxially encircled by cylindrical ground electrode 17C. The reference numerals from FIG. 1 designating the same components are carried over to FIG. 5, but the components will not be described again in detail to avoid repetition. One or more apertures or holes 20 may be formed through side wall of the outer electrode 17C to facilitate radial gas flow between the spark plug gap 18 and the exterior of the outer electrode.

It should be understood that although FIG. 5 does not show projections on the outer end of the ground electrode 17C, the outer end of the electrode may be provided with a plurality of circumferentially spaced projections such as the inverted V-shaped or spherical projections of the embodiments described above. It should also be understood that any of the previously described embodiments showing projections on the outer end of the grounding electrode may be provided with a center electrode having a spherical outer end.

Figure 6:
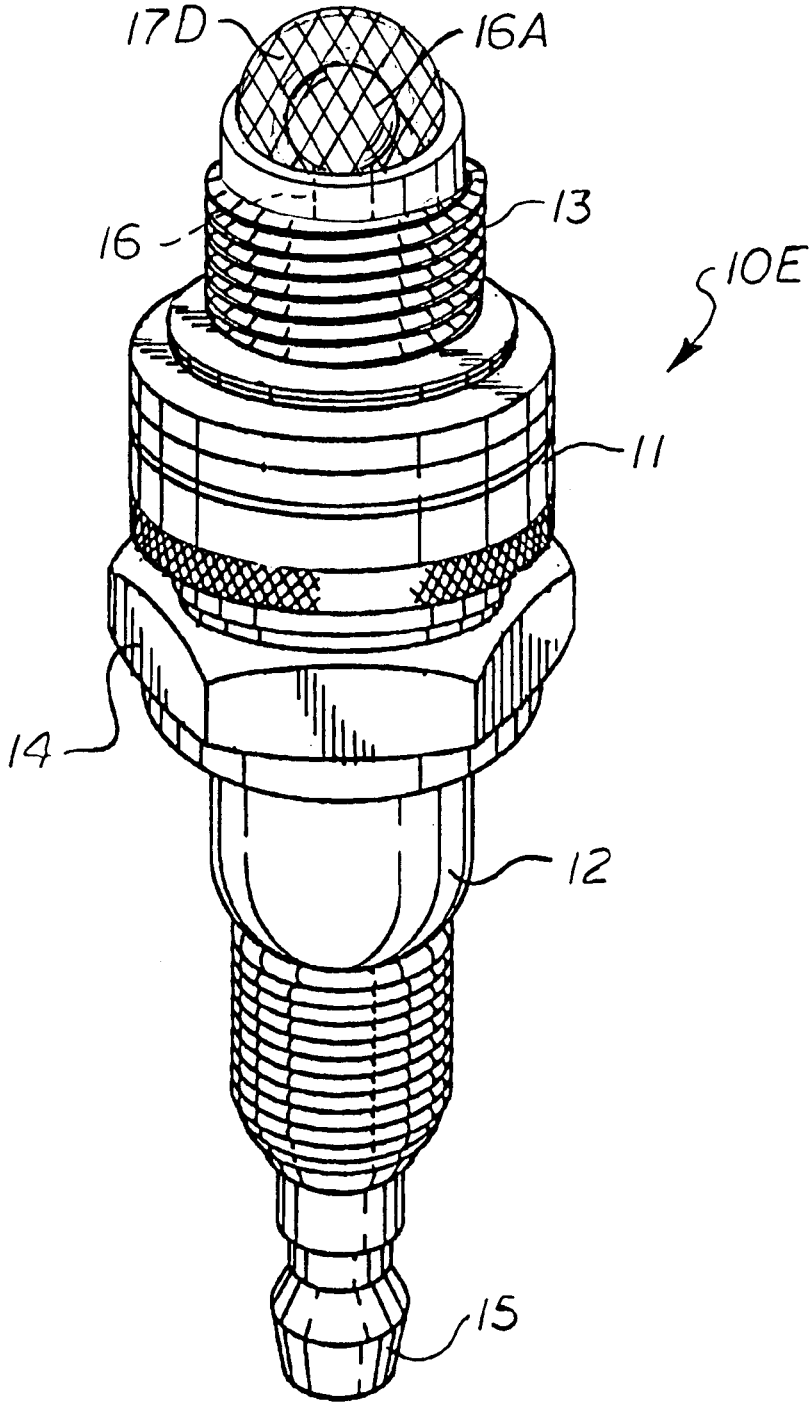
FIG. 6 is a perspective view of a spark plug having a center electrode with a spherical end and a foraminous hemispherical domed ground electrode in accordance with a sixth embodiment of the present invention.

FIG. 6 illustrates a sixth embodiment of a spark plug 10E having a center electrode 16 with a spherical outer end 16A coaxially encircled by foraminous ground electrode 17D. The reference numerals from FIG. 1 designating the same components are carried over to FIG. 6, but the components will not be described again in detail to avoid repetition. In this embodiment, the outer grounding electrode 17D is a hemispherical dome-shaped configuration. The outer electrode 17D is formed of open mesh or expanded metal material having a sieve-like apertured surface. The curved hemispherical surface of the electrode 17D is radially spaced an equal distance outwardly from the outer facing half or hemisphere of the spherical end 16A of the center electrode 16 to define a hemispherical spark plug gap therebetween.

In the embodiment of FIG. 6, the voltage will discharge from the center electrode 16 in the form of a spark that jumps from any point on its spherical end 16A to a point of the inner surface of the dome-shaped hemispherical grounding electrode 17D. The spark will selectively fire across the path of least resistance. Thus, if the opposed surfaces are equally worn and clean and of the same temperature, there could be several separate sparks. In most instances, the spark will sequentially fire outwardly from various areas on the spherical end of the center electrode to various points on the surface of the hemispherical grounding electrode in a random fashion, selecting the start and destination points or areas that are the cleanest, least worn, and have a temperature conducive to grounding the spark. As the spaced apart surfaces become worn or accumulate deposits, the spark will continue to selectively fire from and to the areas offering the path of least resistance. The apertured sieve-like outer electrode 17D facilitates radial gas flow between the spark plug gap and the outer electrode and also causes turbulence in the gas flowing therethrough. The outer electrode 17D may be formed of conventional spark plug ground electrode materials, however stainless steel is preferred.

While this invention has been described fully and completely with special emphasis upon preferred embodiments, it should be understood that within the scope of the appended claims the invention may be practiced otherwise than as specifically described herein.

What is claimed is:

1. A spark plug for internal combustion engines, comprising:

a metal body having a threaded portion for engagement with the cylinder head of the engine and having an extended skirt ground electrode;

a generally cylindrical ceramic insulator secured within said body;

a rod-like center electrode having a longitudinal axis extending through the center of said insulator and said extended skirt ground electrode;

said extended skirt ground electrode having a cylindrical side wall surrounding said center electrode in generally parallel concentric radially spaced relation defining an annulus therebetween and terminating in an outer edge having a plurality of circumferentially spaced alternating V-shaped grooves and inverted V-shaped projections, said V-shaped projections extending vertically outward from said ground electrode along a concentric longitudinal plane parallel with said center electrode axis; and said ground electrode side wall having a plurality of apertures therethrough to facilitate radial gas flow into and turbulence within said annulus between said center electrode and said ground electrode and around said circumferentially spaced V-shaped projections; whereby a spark propagated between said center electrode and said ground electrode is selectively passed to any of said V-shaped projections offering the path of least resistance thereby maintaining maximum firing capability, promoting generally even wear of said projections, and extending the operating life of the spark plug.

2. A spark plug for internal combustion engines, comprising:

a metal body having a threaded portion for engagement with the cylinder head of the engine and having an extended skirt ground electrode;

a generally cylindrical ceramic insulator secured within said body;

a rod-like center electrode having a longitudinal axis extending through the center of said insulator and said extended skirt ground electrode;

said extended skirt ground electrode having a cylindrical side wall extending axially a distance beyond said threaded portion surrounding said center electrode in generally parallel concentric radially spaced relation defining an annulus therebetween and a plurality of circumferentially spaced spherical elements on said outer edge of said ground electrode side wall; whereby a spark propagated between said center electrode and said ground electrode is selectively passed radially to any of said circumferentially spaced spherical elements offering the path of least resistance thereby maintaining maximum firing capability, promoting generally even wear of said projections, and extending the operating life of the spark plug.

3. A spark plug for internal combustion engines, comprising:

a metal body having a threaded portion for engagement with the cylinder head of the engine and having an extended skirt ground electrode;

a generally cylindrical ceramic insulator secured within said body;

a rod-like center electrode having a longitudinal axis extending through the center of said insulator and said extended skirt ground electrode;

said extended skirt ground electrode having a generally cylindrical foraminous sieve-like perforated side wall formed of wire mesh surrounding said center electrode in generally parallel concentric radially spaced relation defining an annulus therebetween and a plurality of openings therethrough to facilitate radial gas flow into and turbulence within said annulus between said center electrode and said ground electrode; whereby a spark propagated between said center electrode and said ground electrode is selectively passed to any point on said side wall offering the path of least resistance thereby maintaining maximum firing capability, promoting generally even wear, and extending the operating life of the spark plug.

4. The spark plug according to claim 3, wherein said foraminous sieve-like perforated side wall formed of wire mesh terminates in an outer edge having a plurality of circumferentially spaced inverted V-shaped projections extending vertically outward from said ground electrode along a concentric longitudinal plane parallel with said center electrode axis; and the spark propagated between said center electrode and said ground electrode is selectively passed to any of said V-shaped projections offering the path of least resistance.

5. A spark plug for internal combustion engines, comprising:

a metal body having a threaded portion for engagement with the cylinder head of the engine and having an extended generally dome-shaped hemispherical ground electrode;

a generally cylindrical ceramic insulator secured within said body;

a center electrode having a rod-like portion extending through the center of said insulator and terminating in an enlarged spherical outer end; and said dome-shaped hemispherical ground electrode having a foraminous sieve-like wall formed of wire mesh surrounding an outer facing hemispherical portion of said center electrode spherical outer end in radially spaced relation defining an annulus therebetween and a plurality of openings therethrough to facilitate radial gas flow into and turbulence within said annulus; whereby a spark propagated between said center electrode spherical outer end and said ground electrode is selectively passed to any surface along said foraminous sieve-like wall offering the path of least resistance thereby maintaining maximum firing capability, promoting generally even wear of said center electrode and said ground electrode, and extending the operating life of the spark plug.

* * * * *